US005701828A

United States Patent [19]

Benore et al.

[11] Patent Number: 5,701,828

[45] Date of Patent: Dec. 30, 1997

[54] ELECTRONIC SECURITY SYSTEM

[75] Inventors: Randolph C. Benore, North Canton; Joseph Gagliano, Canton, both of Ohio; Shawn Gibson, Newago, Mich.; Leo J. Grosswiller, East Canton, Ohio; Gram McGeorge, Spring Lake; Donald Neidlinger, Grand Haven, both of Mich.

[73] Assignee: Diebold, Incorporated, Canton, Ohio

[21] Appl. No.: 672,470

[22] Filed: Jun. 28, 1996

Related U.S. Application Data

[63] Continuation of Ser. No. 305,544, Sep. 14, 1994, abandoned.

[51] Int. Cl.[6] ..... E05G 1/00

[52] U.S. Cl. ..... 109/56; 109/53; 70/278; 340/825.31

[58] Field of Search ..... 70/277–282, 337–339, 70/395; 109/53, 56; 235/382, 491, 492; 361/171, 172; 340/542, 543, 825.31

[56] References Cited

U.S. PATENT DOCUMENTS

| | | | |
|---|---|---|---|
| 3,785,188 | 1/1974 | Drathschmidt | 70/338 |
| 3,800,284 | 3/1974 | Zucker et al. | 340/149 R |
| 4,572,348 | 2/1986 | Eisermann et al. | 194/248 |
| 4,608,932 | 9/1986 | Bohland et al. | 109/56 |
| 4,777,815 | 10/1988 | Lovell et al. | 70/276 |
| 4,851,828 | 7/1989 | Yamashita | 340/825.31 |
| 4,868,914 | 9/1989 | Yamashita | 340/825.31 |
| 4,918,957 | 4/1990 | Eisermann | 70/276 |
| 4,965,551 | 10/1990 | Box | 340/542 X |
| 4,972,182 | 11/1990 | Novik et al. | 340/825.32 |
| 5,140,317 | 8/1992 | Hyatt, Jr. et al. | 340/825.31 |
| 5,193,371 | 3/1993 | Yamane | 70/276 |
| 5,219,386 | 6/1993 | Kletzmaier et al. | 70/277 |
| 5,231,272 | 7/1993 | Mardon | 340/825.31 X |
| 5,337,588 | 8/1994 | Chhatwal | 70/278 |
| 5,359,322 | 10/1994 | Murray | 70/278 X |
| 5,400,722 | 3/1995 | Moses et al. | 70/278 X |
| 5,412,378 | 5/1995 | Clemens | 70/278 X |
| 5,422,634 | 6/1995 | Okubo | 340/825.31 X |
| 5,423,198 | 6/1995 | DiVito et al. | 70/278 |

*Primary Examiner*—Suzanne Dino
*Attorney, Agent, or Firm*—D. Peter Hochberg; Mark Kusner

[57] ABSTRACT

An electronic lock system for controlling access to a plurality of enclosures each having an openable and closeable panel. The system is comprised of a lock mechanism mounted to each of the panels. The lock mechanism has a lock member movable between a first position locking the panel and a second position unlocking the panel. Each of the lock mechanisms has a specific access code allowing movement of the lock member from the first position to the second position. An identification system is provided for identifying individuals authorized for access to one or more of the enclosures. A processing system stores information regarding access codes for each of the enclosures and individual identification information for identifying the enclosure to which an authorized individual is allowed access. A portable key device is used with the lock mechanisms on the panels; the key device having memory programmable by the processing system for storing an access code to a lock mechanism on one of the panels.

24 Claims, 8 Drawing Sheets

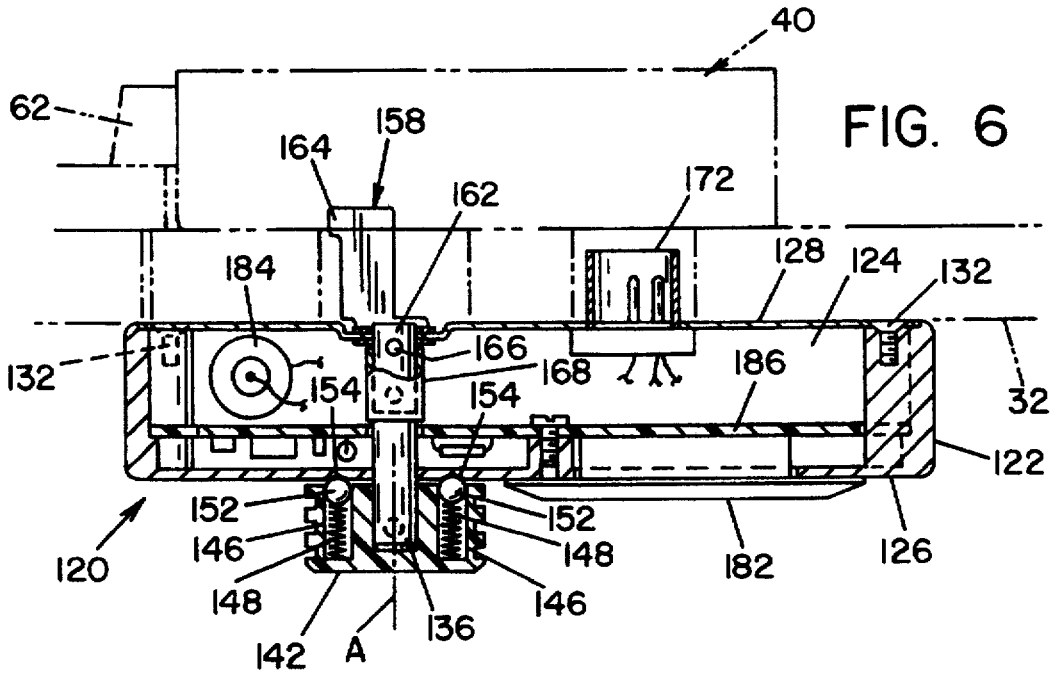
FIG. 6
FIG. 7
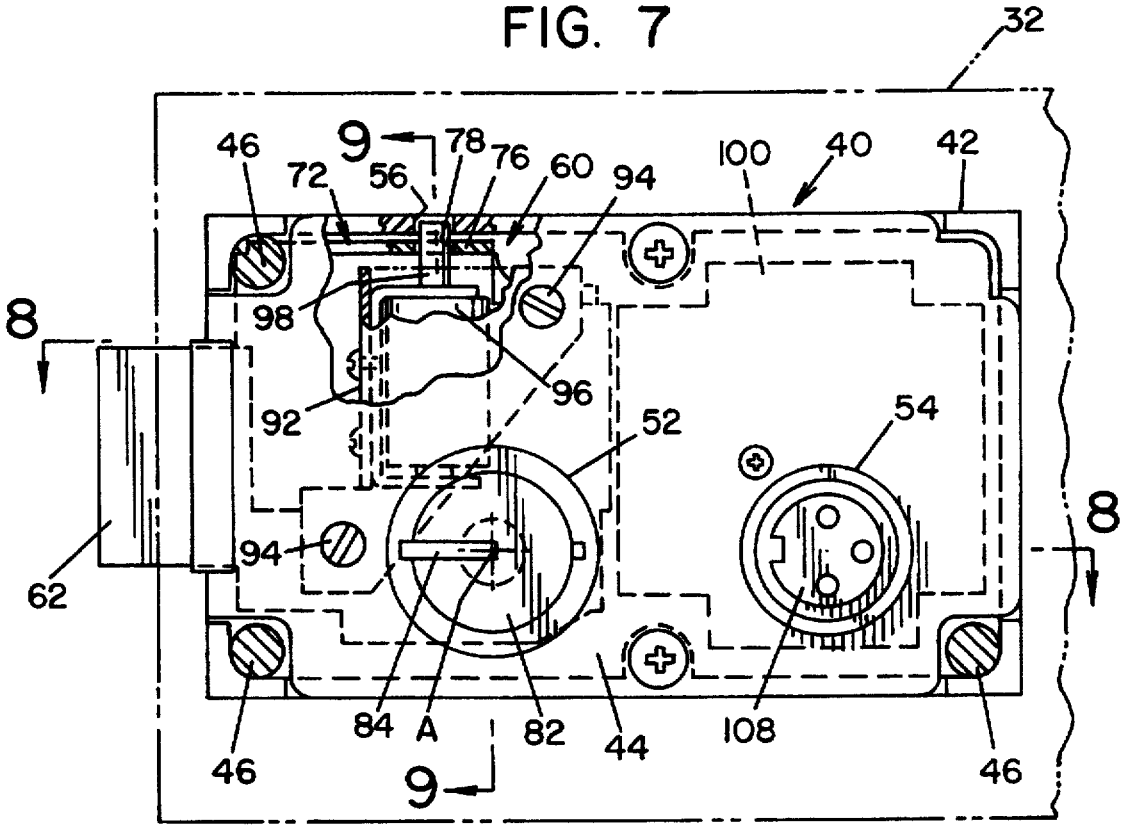

ELECTRONIC SECURITY SYSTEM

This is a continuation of application Ser. No. 08/305,544 filed on Sep. 14, 1994 and now abandoned.

FIELD OF THE INVENTION

The present invention relates generally to electronic security systems, and more particularly to an electronic security system for controlling access to a plurality of boxes, drawers, cabinets or other storage locations. The invention is particularly applicable for use with safe deposit boxes and will be described with particular reference thereto, it being understood, however, that the present invention finds advantageous application in controlling access to other types of multi-compartment storage arrangements.

BACKGROUND OF THE INVENTION

Most banks and financial institutions maintain safe deposit facilities for safe storage of documents and articles. Such facilities are generally comprised of a vault containing an array of side-by-side columns of stacked storage locations. Such storage locations are conventionally referred to as "safe deposit boxes," and are typically used for storing valuable documents or articles. Traditional safe deposit boxes include a plate door having a mechanical lock mechanism which requires two separate keys to open. One key, the customer key, is provided to a renter or user of the safe deposit box, and the other key, the master key, is provided to a bank employee, such as a guard or a teller. Because both keys must be used together to open the mechanical lock on the door of the safe deposit box, a bank employee must be present at the safe deposit box during its opening.

In recent years, electrical safe deposit box systems have been developed. In these systems, the safe deposit box includes a mechanical lock mechanism and an electrical "enabling" system. Each safe deposit box is electrically hard-wired to a central computer, from which a guard or custodian could electrically "enable" the lock mechanism and allow access to the box if the proper customer key is inserted therein. In such electrical safe deposit box systems, the guard or custodial key is basically replaced by the electrically actuated enabling system. Once a customer provides proper identification to the guard or a safe deposit box custodian, the customer may then proceed to the safe deposit box without the guard or custodian present, the enabling system for the particular safe deposit box being energized at the computer terminal.

While such systems have found acceptance in newer financial institutions, they have not been readily accepted in existing institutions because of the major cost of replacing existing mechanical safe deposit box installations. In this respect, many existing facilities have safe deposit boxes which have been in existence for several decades, some dating back to the early 1900's; and it is not unusual for banks to have safe deposit vaults containing thousands of safe deposit boxes. Because the basic design of a safe deposit box has not changed radically since their inception in the late 1800's, these existing mechanical safe deposit box installations are still functional. The cost of retrofitting such systems to a hard wire electrical system would in many instances exceed the cost of installing a completely new electronic safe deposit box system, and in some cases these early safe deposit box structures simply do not include the physical space required to hard wire each box to a central computer. Thus, the cost of converting or replacing a mechanical installation to an electrical one in many instances far outweighs the cost savings of an electronic system, and in many instances, is simply not physically feasible.

The present invention overcomes these and other problems and provides an electronic security system which operates by means of a central computer terminal having a portable programmable access device which enables access to a safe deposit box.

SUMMARY OF THE INVENTION

In accordance with the present invention there is provided an electronic lock system for controlling access to a plurality of enclosures, each having an openable and closeable panel. A lock mechanism is mounted to each of the panels. The lock mechanism has a lock member which is moveable between a first position locking the panel and a second position unlocking the panel. Each of the lock mechanisms further includes a specific access code allowing movement of the lock member from the first position to the second position. Identification means are provided for identifying individuals authorized for access to one or more of the enclosures. Processing means are provided for storing information regarding access codes for each of the enclosures and individual identification information, and for identifying an enclosure the authorized individual is allowed to access. A portable electronic key device is provided for use in unlocking the lock mechanisms on the panels. The key device includes memory means programmable by the processing means for storing an access code to the lock mechanism on one of the panels.

In accordance with another aspect of the present invention there is provided an electronic safe deposit box system comprised of a plurality of safe deposit boxes each having a locking mechanism with a specific access code for unlocking of the locking mechanism. Identification means are provided for receiving user information from a user of the safe deposit box system. Processing means utilize the identification information to identify a safe deposit box and a corresponding access code from the table of such information. A portable electronic key device is provided for use with the locking mechanism to unlock same. The key device includes memory means programmable by the processing means for storing a safe deposit box number and a corresponding access code number.

In accordance with another aspect of the present invention there is provided an electronic door locking apparatus comprised of an electronic lock carried by the door, including a locking mechanism movable between a locking condition and an unlocking condition. An electrically actuatable element regulates movement of the locking mechanism from a locking condition to an unlocking condition. Circuit means are provided for controlling the electrically actuatable element, the circuit means including memory means for storing an access code. Receptacle means are provided on the door for receiving a mechanical element for operative engagement with the locking mechanism and for receiving an electrical element for operative engagement of the circuit means. A lock controller for operative attachment to the electronic lock is provided. The lock controller includes a power source and circuit means controlling the power source. The circuit means includes programmable means for storing and conveying an access code. An electrical element is connectable to the power source and engageable with the receptacle on the door lock. A mechanical element is engageable with the receptacle means on the door lock. A control system for programming the controller is provided and includes memory means for storing access codes, receptacle means for receiving the electrical element and the mechanical element of a controller, and circuit means for imparting access code information to the controller.

In accordance with another aspect of the present invention there is provided an electronic lock system for controlling access to a plurality of left-hand opening and right-hand opening compartments, comprising compartments each having a specific identification and having a lock mechanism with a specific access code for unlocking the lock mechanism. Processing means are provided for storing the identification and access code for each compartment and information identifying each compartment as a left-hand opening compartment or a right-hand opening compartment. A portable electronic key device attaches to each of the lock mechanisms on the compartments. The electronic key device is attachable to said left-hand opening in a first orientation, and is attachable to the right-hand opening compartments in a second orientation. The electronic key device has memory means programmable by the processing means for storing the identification, access-code and the opening direction of one of the compartments, and display means for displaying the identification stored in the memory means. The display means includes means for displaying the identification number in a readable orientation based upon the opening direction of the compartment.

In accordance with another aspect of the present invention there is provided an electronic lock system for controlling access to a plurality of enclosures each having an openable and closeable panel. The system includes a lock mechanism mounted to each of the panels. The lock mechanism has a mechanical lock member movable between a first position locking the panel and a second position unlocking the panel. Each of the lock mechanisms has electronic circuit means including memory means for storing a specific access code and lock control means allowing movement of the lock member from the first position to the second position. Processing means are provided for storing information regarding access codes for each enclosure lock mechanism. A portable electronic key device is used with the panels. The electronic key device includes mechanical connection means for connection with the lock member and electronic connection means for connection with the electronic circuit means in the lock mechanism, said electronic key device further including memory means programmable by the processing means for storing an access code to a lock mechanism on one of the panels, and an electrical power source for energizing the control means in the lock mechanism.

In accordance with another aspect of the present invention there is provided an electronic safe deposit box system comprised of a plurality of safe deposit boxes each having a safe deposit box identification number and a lock mechanism. The lock mechanism includes an electronic circuit with a specific electronic access code allowing unlocking of the lock mechanism. Self contained processing means is provided for storing information identifying each of the safe deposit boxes and its corresponding access code. A self contained portable electronic key has memory means programmable by the processing means for storing an access code. The electronic key is attachable to each of the safe deposit boxes with the memory means communicating with the electronic circuit within said lock mechanism to transfer the access code between the electronic key device and the electronic circuit.

In accordance with another aspect of the present invention there is provided a method for controlling access to a plurality of enclosures each having an openable and closeable panel, comprising the steps of providing each of the panels with a lock mechanism having a mechanical lock member movable between a first position locking the panel and a second position unlocking the panel, each of the lock mechanisms having a specific electronic access code allowing movement of the lock member from the first to the second position; storing the access code for each of said panels in a remote electronic processing means; transferring the access code for a selected enclosure to be opened from the electronic processing means to a portable electronic transfer device, transporting the electronic transfer device to the selected enclosures; and electronically communicating the electronic access code from the electronic transfer device to the lock mechanism.

It is an object of the present invention to provide an electronic security access control or lock system for a storage system having multiple storage locations.

Another object of the present invention is to provide an electronic system as described above wherein each storage location has an electronic lock having an individual electronic access code.

Another object of the present invention is to provide a system as described above wherein a single, portable programmable electronic key device may be used to control access to each of the storage locations.

Another object of the present invention is to provide a system as described above wherein the power required to control the electronic lock is carried by the programmable electronic key device.

Another object of the present invention is to provide an electronic safe deposit box system wherein a portable, programmable key device controls access to the safe deposit boxes.

Another object of the present invention is to provide an electronic safe deposit box system as described above wherein each of the safe deposit boxes has a distinct access code.

Another object of the present invention is to provide an electronic safe deposit box system as described above which includes a central control system for storing access code information for accessing each of the safe deposit boxes in a programmable, portable electronic key device for conveying such access codes from the central control system to the safe deposit box.

Another object of the present invention is to provide an electronic safe deposit box system as described above which includes custom identification means for identifying a customer.

Another object of the present invention is to provide a safe deposit box system as described above wherein each safe deposit box includes an electronically controlled locking mechanism.

A still further object of the present invention is to provide an electronic safe deposit box system as described above wherein the electronically controlled locking mechanism is externally powered.

A still further object of the present invention is to provide a method of controlling access to a plurality of enclosures using a programmable portable electronic key.

These and other objects will become apparent from the following description of a preferred embodiment taken together with the accompanying drawings.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof and wherein:

FIG. 6 is a sectional view taken along lines 6—6 of FIG. 4;

FIG. 7 is a partial broken front elevational view of a lock mechanism according to an embodiment of the present invention shown on a door panel (shown in phantom) of a safe deposit box;

DETAILED DESCRIPTION OF PREFERRED EMBODIMENT

Figure 1:
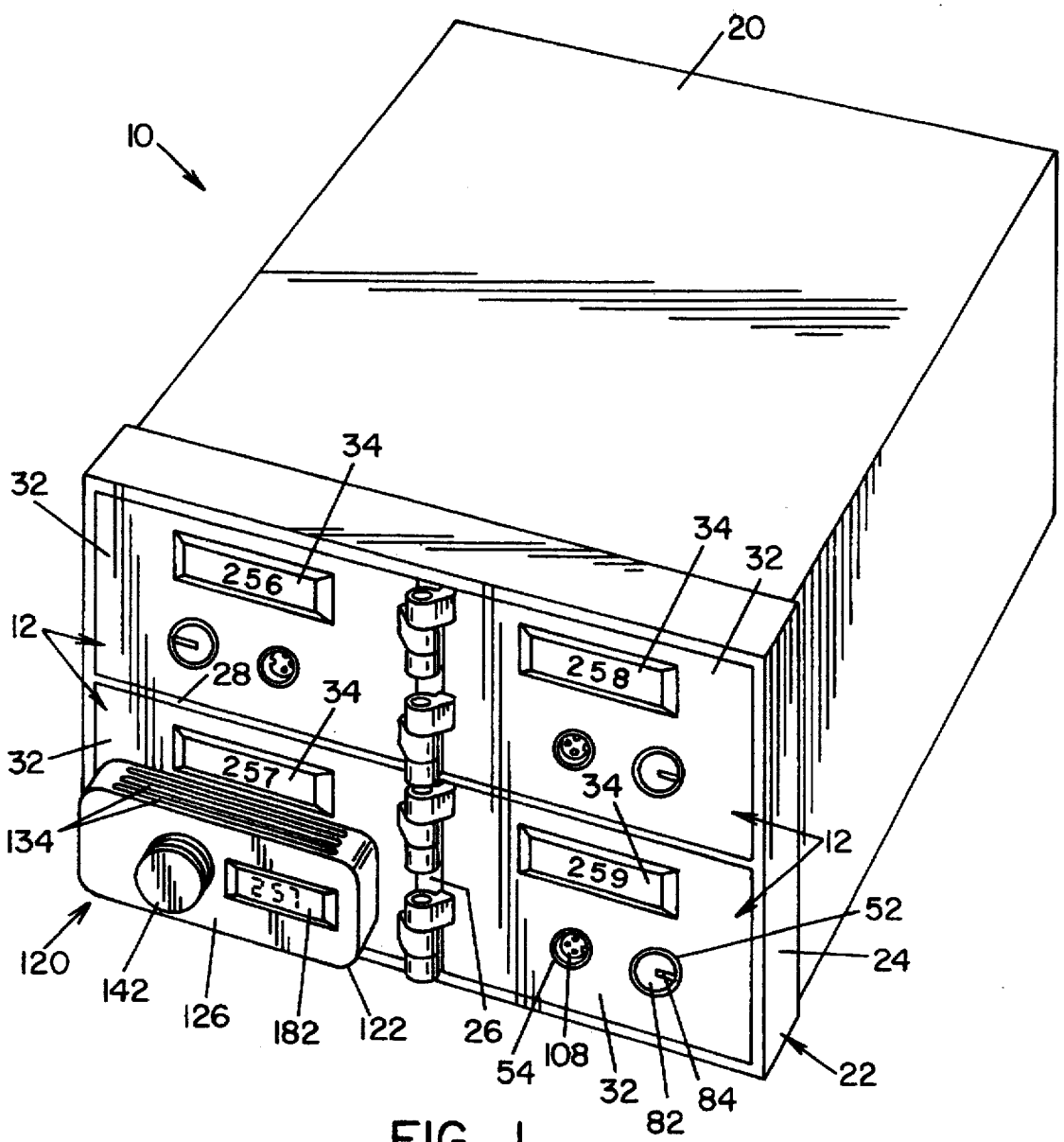
FIG. 1 is a front perspective view of a group of four safe deposit boxes, one of the safe deposit boxes having an electronic access key device according to the present invention mounted on the door thereof.

Referring now to the drawings wherein the showing is for the purpose of illustrating a preferred embodiment of the invention, and not for the purpose of limiting same, an electronic lock system for a safe deposit box installation is shown. A conventional safe deposit box installation typically includes hundreds, and in many instances, thousands of safe deposit boxes. For the purpose of illustration, a safe deposit box installation 10 comprised of four safe deposit boxes 12 is shown in FIG. 1. As used hereinafter the term "safe deposit box" shall refer generally to a storage location within installation 10, where articles or documents are stored. In this respect, each storage location within a safe deposit box installation would typically contain a storage box or container which is locked within one of many separate cubicles or compartments within the installation.

Safe deposit boxes 12 are defined by a rectangular housing 20 having a closed back side (not shown) and a front side having a door frame assembly 22 attached thereto. Within housing 20, a vertical divider (not shown) and horizontal shelves (not shown) divide the rectangular cavity defined by housing 20 into four cubicles, each of which contains the aforementioned removable box or container. Door frame assembly 22 encloses the open front end of housing 20. Door frame assembly 22 is typically formed of an extruded metal frame 24, a central hinge mounting post 26 and a vertical divider 28. Hinge mounting post 26 is designed to support pivotally mounted doors panels 32 which enclose the open end of each cubicle or compartment within housing 20. The doors or panels 32 are typically formed of a plate metal material. In the embodiment shown, each door includes a rectangular placed 34 which contains a safe deposit box identification number. The boxes shown in the drawings are identified by safe deposit identification numbers (I.D. Nos.) 256, 257, 258 and 259. Safe deposit box installation 10 as heretofore described is generally conventionally known. The interior assembly of housing 20 and the structure of the removable container in and of themselves form no part of the present invention and therefore have not been described.

Figure 8:
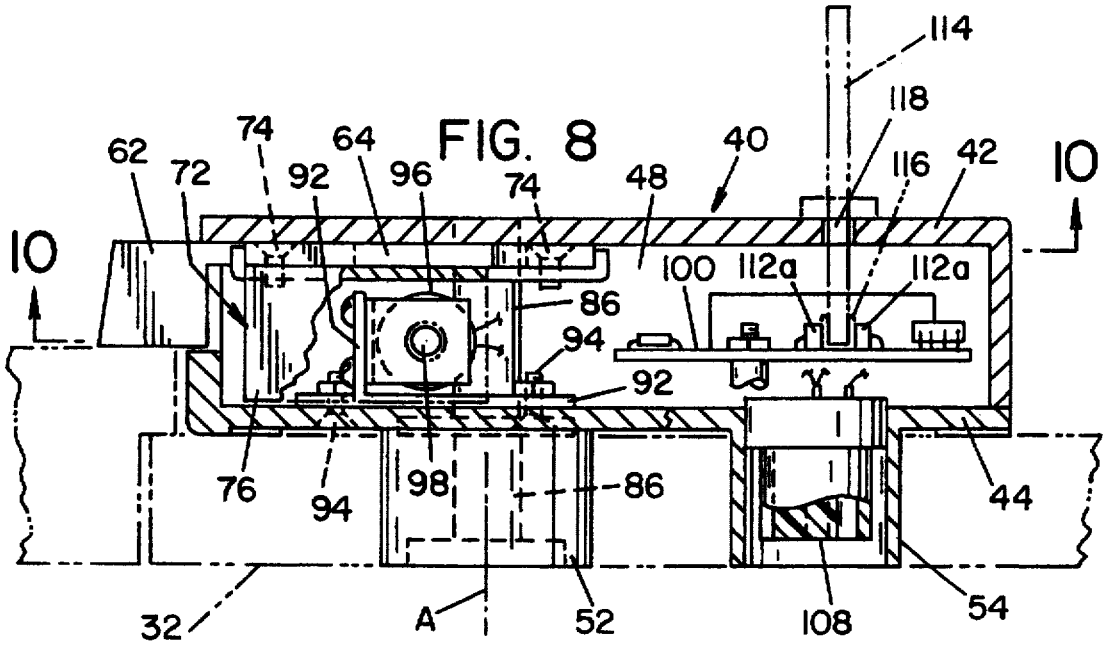
FIG. 8 is a sectional view taken along lines 8—8 of FIG. 7.
Figure 9:
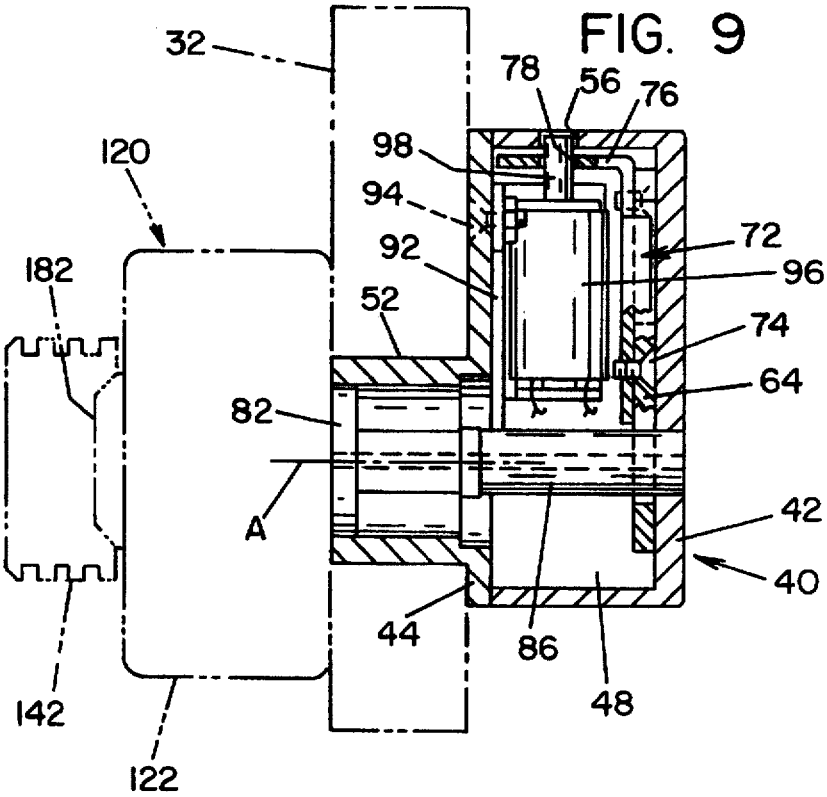
FIG. 9 is a sectional view taken along lines 9—9 of FIG. 7.

A lock assembly 40 is attached to the inner surface of each door panel 32. Lock assembly 40, best seen in FIGS. 7–9, includes a housing 42 and a cover 44 which together are attachable to the inner surface of the door panel 32 by conventional fasteners 46. Housing 42 is generally rectangular in shape and defines an inner cavity 48 dimensioned to contain a lock mechanism 60 and an electronic circuit 100. Cover 44 is generally a flat plate having two spaced-apart cylindrical bosses 52, 54 extending to one side thereof. Bosses 52, 54 define cylindrical openings which communicate with cavity 48. Bosses 52, 54 are dimensioned to extend through openings in door panel 32 as best seen in FIG. 9. According to one aspect of the present invention, bosses 52, 54 are preferably dimensioned and spaced apart so as to be receivable into openings on doors of conventional existing mechanical safe deposit lock installation, such that such mechanical systems may be retrofit with the present electrical lock assembly.

Lock mechanism 60 is generally comprised of a lock bolt 62 having a lock bolt extension plate 64 which is preferably integrally formed therewith. Lock bolt 62 is generally rectangular in shape and extends through a rectangular opening in housing 42. Extension plate 64 is flat and includes a generally tear-drop shaped opening 66 formed therethrough. Opening 66 defines opposed cam surfaces **66*a*, 66*b*. A latch bracket 72 is secured to lock bolt extension plate 64 by fasteners 74, as best seen in FIG. 9. Latch bracket 72 includes a latch plate 76 which projects generally perpendicularly to lock bolt extension plate 64. A cylindrical aperture 78 is formed in latch plate 76. Aperture 78 is dimensioned and positioned to be alignable with a similarly-sized aperture 56, best seen in FIG. 10, formed in lock housing 42**.

Figure 10:
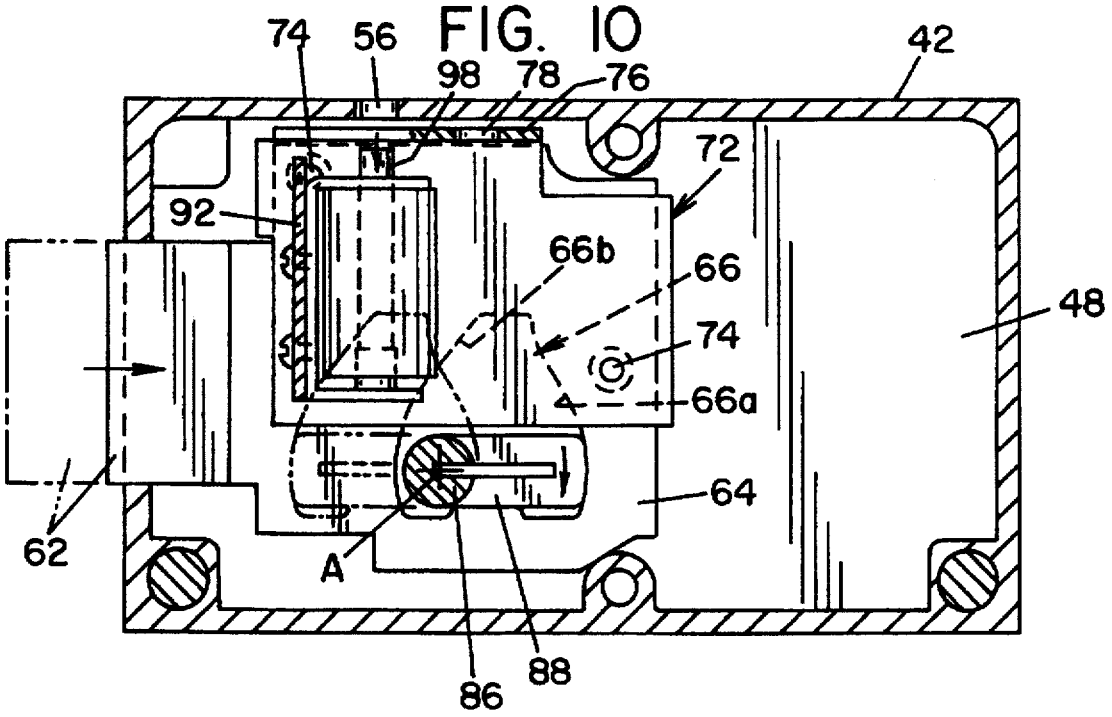
FIG. 10 is a sectional view taken along lines 10—10 of FIG. 8.

Lock mechanism 60 also includes a rotatable lock cylinder 82 which is disposed within boss 52 of cover 44. Cylinder 82 incudes an elongated slot 84 dimensioned to receive a mechanical key or blank. Cylinder 82 is rotatable about an axis, designated "A" in the drawings, and includes a shaft 86 having a cam element 88 at the end thereof. Shaft 86 is dimensioned such that cam element 88 is positioned within tear-drop shaped opening 66 with the end of cam element 88 engageable with cam surface **66*a*, 66*b*. In this respect, if a proper-shaped key is inserted in slot 84, cylinder 82 is rotatable about axis A and is operable by means of cam element 88 engaging cam surfaces 66*a*, 66*b* to move the lock bolt 62 between a first position wherein the lock bolt 62** extends from the lock housing 42 (i.e., a locked position as best seen in FIG. 9) and a second position wherein the lock bolt 62 is retracted into the housing 42 (i.e., an opened position as best seen in FIG. 10).

A mounting bracket 92 is secured to the inner surface of cover 44 by conventional fasteners 94. Mounting bracket 92 is generally C-shaped and adapted to support an electromechanical actuator 96. In the embodiment shown, electromechanical actuator 96 is a solenoid having a cylindrical pin 98 projecting therefrom. Pin 98 has a normal extended position, best shown in FIGS. 7 and 9, when electromechanical actuator 96 is unenergized, and a retracted position, shown in FIG. 10, when electromechanical actuator 96 is electrically energized. Mounting bracket 92 positions electromechanical actuator 96 such that pin 98 is alignable with, and can extend through, aperture 78 in latch plate 76 and aperture 56 in lock housing 42, as best seen in FIGS. 7 and 9.

Figure 13:
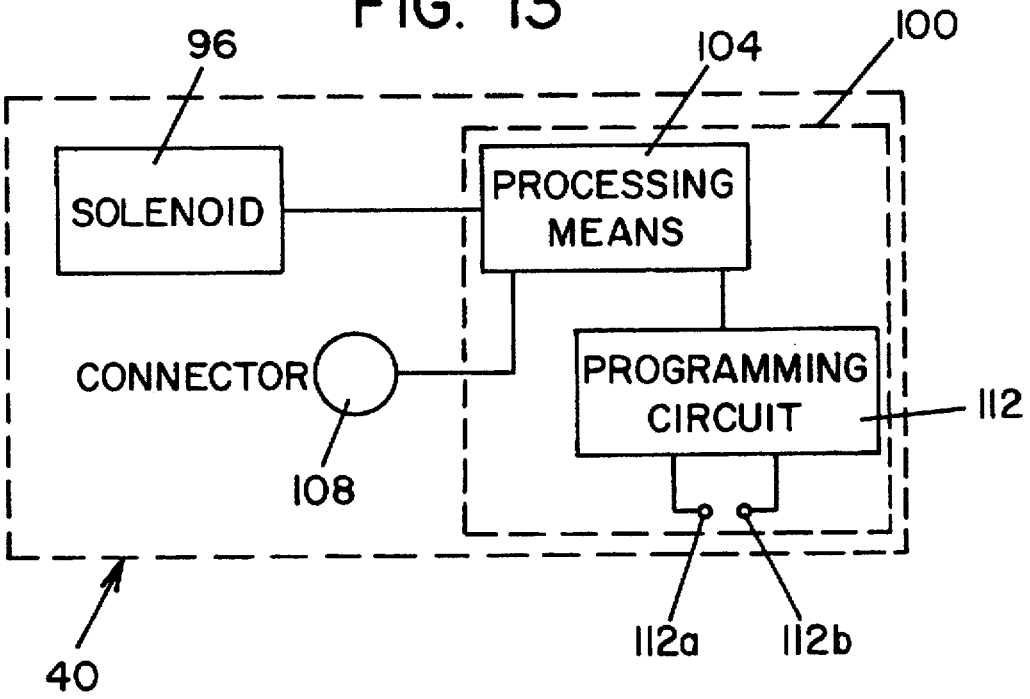
FIG. 13 is a schematic representation of the electronic components within a lock mechanism.

Electromechanical actuator 96 forms part of an electronic circuit, which is schematically illustrated in FIG. 13. In the embodiment shown, electronic circuit is basically comprised of a printed circuit (PC) board 100, which is electrically connected to electromechanical actuator 96, and which includes processing means 104. Processing means 104 includes: 1) programmable read/write memory means operable to receive and store access code information (i.e., a combination number) from an external communication source; 2) delay means operable to establish a predetermined communication transfer rate between the memory means and the external communication source; 3) comparator means operable to compare information from the external communication source (i.e., access code information) with the access code information stored in memory means; and 4) control means for controlling operation of electromechanical actuator 96. Connector means 108 are provided to enable electronic circuit 100 to be connected to the external communication source.

According to one aspect of the present invention, the data communication transfer rate established by the delay means of processing means 104 is considerably slower than conventional processing speeds. In accordance with another aspect of the present invention, PC board 100 is adapted to receive electrical power, in addition to communication information, from the external communication source. To this end, in the embodiment shown connector means 108 is comprised of a DIN connector that is electrically connected to PC board 100 as best seen in FIG. 13. Connector 108 is disposed within the cylindrical opening defined by boss 54. The control means of processing means 104 is provided to control energization of electromechanical actuator 96 in response to input from comparator circuit means.

Basically, PC board 100 is designed to receive electrical power and access code information from an external source, and to actuate and control electromechanical actuator 96 upon receipt of a proper access code. In this respect, processing means 104 is adapted to energize electromechanical actuator 96 to remove solenoid pin 98 from aperture 56 in lock housing 42 and aperture 78 in latch plate 76 so as to allow movement of the lock bolt 62. As indicated above, power to energize electromechanical actuator 96 is received from an external source. The comparator means of processing means 104 compares the access code information stored within the memory means with an access code received from the external source. If the entered access code matches the stored access code in the programmable memory means, processing means 104 is operable, via power supply from the external power source, to actuate solenoid 92 and permit movement of the lock bolt 62.

Figure 11:
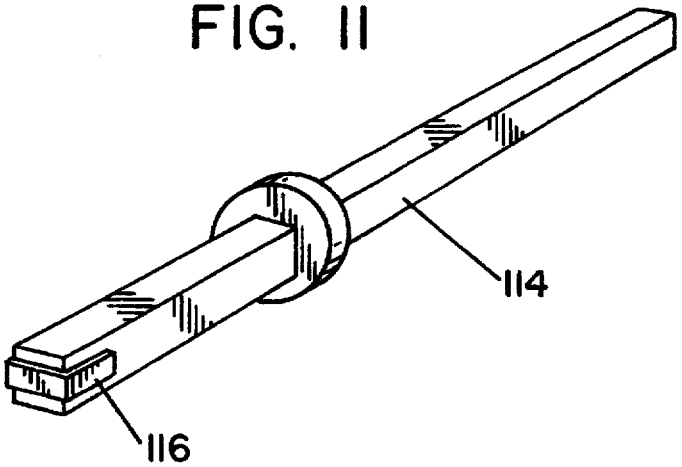
FIG. 11 is a perspective view of an element used for programming an access code to memory of a lock mechanism.
Figure 12:
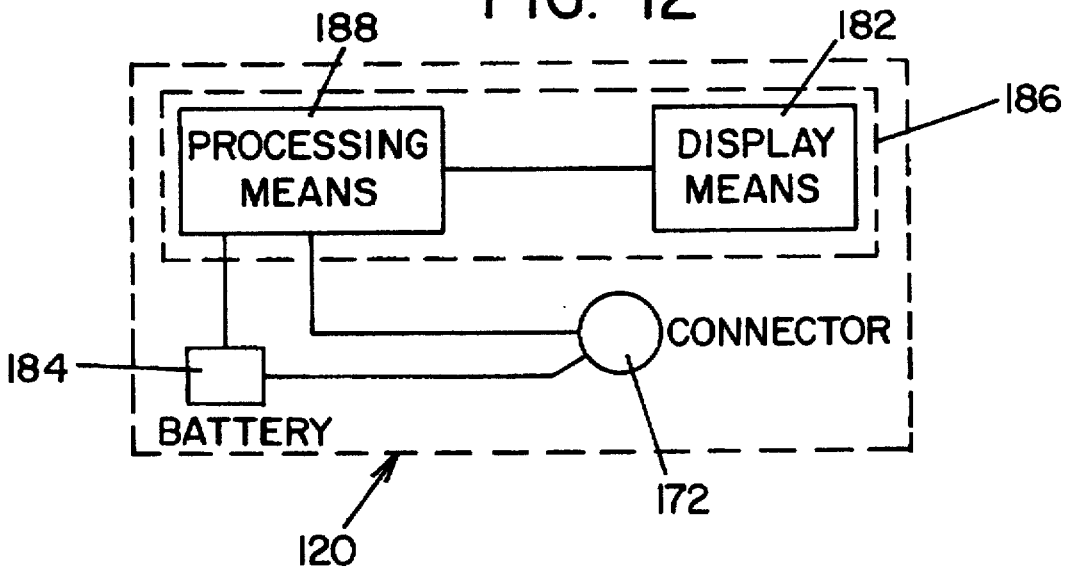
FIG. 12 is a schematic representation of the electronic components within the electronic access key device.

PC board 100 also includes a programming circuit 112 for writing access code information into the memory means of processing means 104. In the embodiment shown, programming circuit 112 prevents normal writing to the memory means without the use of a special element 114, best seen in FIG. 11. In the embodiment shown, element 114 is an elongated wand which includes an electrically conductive band or strip 116 at one end thereof. Wand 114 is insertable through an opening 118 in lock housing 42, as illustrated in FIG. 8 to complete or connect spaced-apart contacts **112*a*, 112*b* of programming circuit 112. Element 114 is operable to complete the break in programming circuit 112 allow an access code to be programmed into the memory means 102**.

Figure 3:
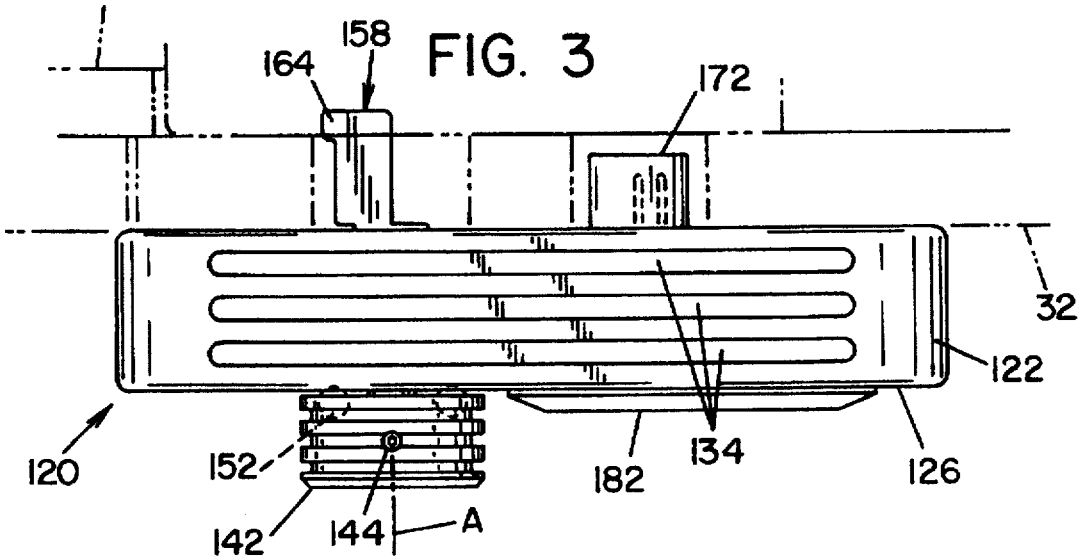
FIG. 3 is a side elevational view of an electronic access key device as shown in FIG. 1.
Figure 4:
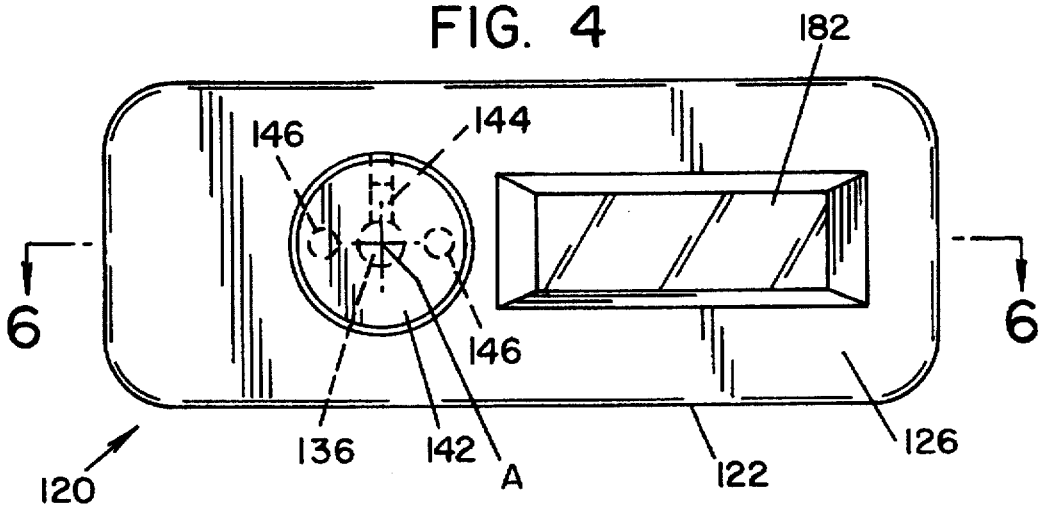
FIG. 4 is a top plan view of the electronic key device shown in FIG. 3.
Figure 5:
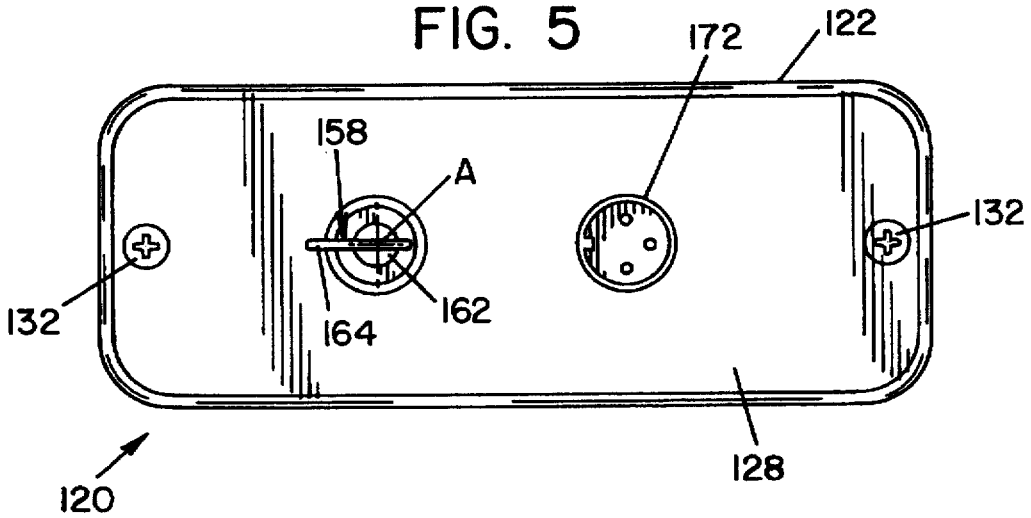
FIG. 5 is a bottom plan view of the electronic key device shown in FIG. 3.

Referring now to FIGS. 3, 4 and 5, a portable, programmable access key device 120 is shown. According to the present invention, key device 120 is a portable unit adapted for use with lock assembly 40 for unlocking the safe deposit boxes 12. Key device 120 is generally comprised of a rectangular housing 122 which defines an inner, generally rectangular cavity 124 that basically contains mechanical and electrical opponents for operative engagement with the aforementioned lock assembly 40. Housing 122 includes a front face panel 126. A removable back plate 128, best seen in FIG. 5, is secured to housing 122 by conventional fasteners 132. Sets of elongated parallel grooves 134 are formed along the longitudinal sides of the housing 122, as best seen in FIG. 3. A shaft 136, best seen in FIG. 6, extends through the housing 122 and is rotatable about an axis, designated "A" in the drawings. A knob 142 is connected by a set screw 144 to the end of the shaft 136 which projects through front panel 126. Knob 142 includes two cylindrical recesses 146 which are adapted to receive a biasing spring 148 and a detent ball 152. Detents 154 are formed in the outer surface of front panel 126 of housing 122 to receive detent balls 152 and to define distinct rotational positions for knob 142. An actuator blade or key 158 is attached to the other end of shaft 136 to be rotatable therewith. Actuator blade 158 is generally a flat blank having a shank portion 162 and an actuator portion 164. In the embodiment shown, shank portion 162 of actuator blade 158 is received within a slot formed within the end of shaft 136. Pins 166 extending through shaft 136 and shank portion 162 of actuator blade 158 secure actuator blade 158 to shaft 136. A sleeve 168 surrounds shaft 136 and shank portion 162 to ensure and maintain the connection therebetween. Actuator portion 164 has a profile dimensioned to be received in slot 84 of lock cylinder 82, and is operable to rotate cylinder 82 upon rotation of knob 142.

An electrical connector 172 extends from back plate 128 adjacent actuator blade 158. Connector 172 is designed and dimensioned to be received within, and electrically mate with, connector 108 on the lock assembly 40. In this respect, actuator blade 158 and connector 172 are spaced apart to be simultaneously connectable with connector 108 and cylinder 82 of lock assembly 40. Display means 182 are provided on the front panel 126, as best seen in FIG. 4. In the embodiment shown, display means 182 is comprised of an alphanumeric electronic LED (light emitting diode) display. As will be appreciated, a LCD (i.e., liquid crystal display) may also be used. According to the present invention, an electrical power unit 184 is contained within housing. Power unit 184 is preferably comprised of rechargeable electrical batteries. As best seen in FIG. 6, a printed circuit board 186 is disposed between display means 182 and power unit 184. Circuit board 186 is secured by conventional fasteners to mounts formed within housing 122. Circuit board 186 contains an electronic control circuit which is connected to power pack 184, display means 182 and connector 172.

According to the present invention, the electronic circuit on circuit board 186 preferably includes processing means 188 including: 1) programmable memory means for storing access code information and safe deposit box ID information; 2) means for reading and writing to the memory in lock assembly 40; 3) communication means for controlling communications processing speeds; 4) comparator means for comparing an access card stored in memory in lock assembly 40 with an access code programmed into access key device 120; 5) means for controlling display means 182, and 6) timing control means for limiting select operations.

Figures 2, 2A:
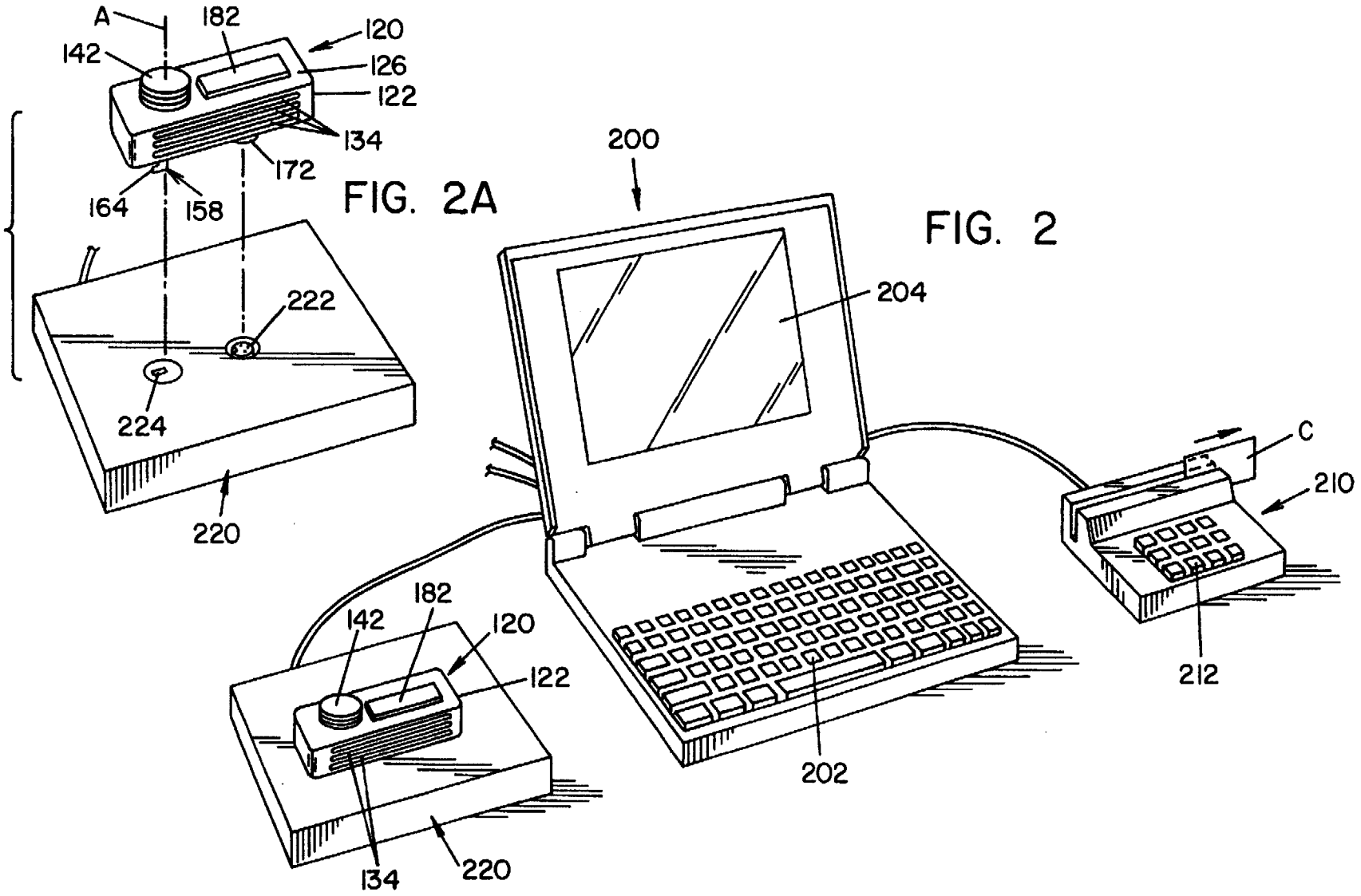
FIG. 2 and FIG. 2A are perspective views of a safe deposit box system terminal illustrating a preferred embodiment of the present invention and showing customer identification means and an access key programmer in accordance with the present invention.

Referring now to FIG. 2, a central control terminal 200 for the security system is shown. In the embodiment shown, the central control terminal 200 is a conventional computer having a keyboard 202 for imputing information and instructional data, and a display screen 204 for displaying information and instructional prompts. Central control terminal 200 is connected to customer identification means 210, which in the embodiment shown is comprised of a card reader terminal for reading a magnetic and coded card designated "C" in the drawings. The card reader includes key pad 212 for inputting a personal identification number (PIN) as is conventionally known. As will be appreciated from a further reading of the present specification, customer identification means 210 may be comprised of other devices for identifying a system user. For example, physical identification means such as palm readers, fingerprint readers, retina scanner, or even a voice recognition device may be used. Further mechanical devices such as IR key readers, or dallas chips may be used for the purpose of identifying an authorized user of the system. In this respect, the basic function of customer identification means 210 is to identify an authorized user of the safe deposit box system.

Customer identification means 210 is electronically connected to the central control terminal 200 to convey customer identification information to such terminal. The central control terminal includes: 1) memory means for storing files relating to customer identification means, safe deposit box identification numbers and safe deposit box type (i.e., right-hand or left-hand box) and corresponding access code numbers for each of the safety deposit boxes in the electronic safe deposit box system; 2) verification means for verifying customer identification information; 3) processing means for identifying one or more safe deposit boxes and corresponding access codes once customer identification information is obtained from the identification means and after such information is compared and verified with files in memory; 4) means for writing access code information to memory of access key device 210; 5) means for recharging power source 184 within access key device 120, 6) record means for maintaining financial records relating to use of the security system by customer or bank personnel, and 7) algorithm means for generating random numbers.

Central control terminal 200 is electronically connected to a programming terminal 220. Programming terminal 220 includes an electrical connector 222 designed to receive connector means 108 of the access key device 120. A slot 224 is positioned relative to the connector 222 to receive actuator blade 158 on the access key device 120 so as to allow the access key device 120 to be electrically connected to programming terminal 220. Programming terminal 220 is basically an interface between the central control terminal 200 and access key device 120, to facilitate transfer of safe deposit box identification information and access code information to access key device 120.

OPERATION

Referring now to the operation of the present invention, each safe deposit box in a safe deposit box installation has a specific safe deposit box identification number. In the embodiment shown, safe deposit box identification nos. 256, 257, 258 and 259 identify the four safe deposit box 12 locations shown in FIG. 1. According to the present invention, each safe deposit box 12 has a corresponding access code comprised of an eight hexadecimal digit number. Using an eight (8) byte number (i.e., a sixteen (16) digit hexadecimal number) provides a system having $10^{19}$ distinct access codes. According to the present invention, one and only one access code is assigned to each safe deposit box 12, and no two safe deposit boxes 12 have like access codes.

The access code for each safe deposit box is preferably programmed into memory of each lock mechanism 40 at the installation site. In this respect, a safe deposit box number (i.e., the I.D. number) is generally not assigned to a safe deposit box until all the safe deposit boxes in a given installation have been assembled and installed. This is because conventional safe deposit boxes are typically fabricated in modular units, each unit having a plurality of like-sized safe deposit boxes. The size and number of safe deposit boxes in a given unit can vary. These modular units may be organized and stacked in numerous configurations based upon a customer's demands. Accordingly, the safe deposit boxes are not given I.D. numbers until the assembly and installation of the modular units is completed. Consequently, the access code for a given safe deposit box, which access code must relate to or be associated with the safe deposit box identification number, will in most instances be assigned at the installation site. A "lap top" or "notebook" computer (i.e a programming computer) having a special connector for attachment to connector 108 of lock mechanism 40 may be used to program the access code to each safe deposit box. With respect to programming access codes into the memory of each lock assembly 40, as indicated above, lock assembly 40 includes a programming circuit 112 having a break or gap defined between two contacts **112*a*, 112*b*. This gap or break in programming circuit 112 prevents programming or reprogramming of the memory of processing means 104. In the embodiment shown, element 114 is provided to complete programming circuit 112. Element 114 is insertable through opening 118 in lock housing 42, as illustrated in FIG. 8, such that conductive strip 116 at the end of element 114 engages contacts 112*a*, 112*b* to complete programming circuit 112. Only with element 114 in place can the memory of processing means 104** be programmed or reprogrammed with an access code. According to the present invention, the eight byte access code for each safe deposit box is randomly generated using a number generating algorithm within the "programming" computer. Preferably, each successive access code is checked against existing access codes already in memory within the "programming" computer to ensure duplicate codes do not exist.

The access codes and corresponding safe deposit box numbers would be stored to a media storage device, such as a magnetic floppy disk, or CD ROM, for transfer to the installation's central control terminal 200, and for archival storage as a backup to the system. In a similar manner, safe deposit box installations which are retrofitted to a system as herein described, i.e. where conventional mechanical locks are replaced with the lock assemblies 40, may have the access codes programmed therein.

When a safe deposit box 12 is initially rented to a user, a user file is set up in central control terminal 200. The file would contain customer identification information, initially obtained from identification means 210. A specific safe deposit box and its corresponding access code would be assigned to the customer. This information, i.e. the safe deposit box number and access code, together with customer identification information and other financial information, i.e. customer's address, account numbers, are associated by processing means within central control terminal 200 and stored in memory.

As heretofore described, the access code for each safe deposit box is initially assigned prior to the first rental of the safe deposit box. For a subsequent rental of the same box to another customer (e.g. when the initial customer terminates his lease of the box), it may, in some situations, be desirable to change the access code to the safe deposit box. To reprogram the access code for a specific safe deposit box, the central control terminal 200 would randomly generate an eight byte access code using the internally stored algorithm. Again, the generated access code would be checked against existing access codes already in memory to ensure duplicate codes do not exist. The generated code is then programmed into electronic access key device 120, using programming terminal 20. Using wand element 114 to complete programming circuit 112 within lock assembly 40, the randomly generated access code is written to the memory of processing means 104 of door lock assembly 40 by connecting electronic access key device 120 thereto (i.e., by attaching to it the selected safe deposit box). The new access code is then programmed into the memory of processing means 104 of lock mechanism 40.

In summary, each safe deposit box 12 in a particular installation is assigned an access code in memory in lock assembly 40. The safe deposit box identification number and its corresponding access code number are stored in memory with the central control terminal 200. Preferably, the access code is stored in an encrypted secure file within central control terminal 200 to prevent easy access to them by the users of the system. When a safe deposit box is rented, customer identification information regarding the individual renting a safe deposit box is associated with the specific safe deposit box which is rented and its corresponding access code. In this respect, central control terminal 200 maintains in memory, customer identification information used to identify an authorized individual together with the safe deposit box identification number and corresponding access codes for any safe deposit box rented by such individual.

To gain access to his or her safe deposit box, a user must first provide sufficient identification means to identify the user as an authorized individual. In the embodiment shown, such identification means information would be provided by means of a magnetically encoded card C which would be passed through the scanning slot of customer identification means terminal 210. In addition to having possession of the appropriate magnetically encoded card, the user would also be required to insert a PIN number using keypad 212, as is a conventionally known procedure with the use of magnetically encoded cards. With the customer information obtained from the identification means 210, central control terminal 200 would verify such information against that stored in its memory to identify if the individual is indeed an authorized user (i.e., renter) of a safe deposit box 12 in the safe deposit box system.

If the individual is an authorized user of the safe deposit box system, central control terminal 200 will identify internally the customer's safe deposit box identification number and its corresponding access code. With an access key device 120 in place on programming terminal 220, information regarding the customer's safe deposit box identification number and corresponding access code are conveyed to electronic circuit 186 of the access key device 120. Electronic circuit 186 of the access key device 120 is operable to display the safe deposit box number on display means 182. For example, if the rented safe deposit box 12 were safe deposit box number 257 as shown in FIG. 1, display means 182 on the access key device 120 would display "257," as shown in FIG. 1. In addition to displaying the customer's safe deposit box identification number on display means 182, the corresponding access code is read in the programmable memory within electronic circuit 186 of the access key device 120. According to one aspect of the present invention, the timing means of electronic control circuit 186 of access key device 120 limits the time that access key device 120 maintains the programmed information in memory. In other words, key access device 126 must be used by a customer within a select period of time, or else it is no longer operative and must be reprogrammed by central control terminal 200. In the embodiment described, a ten (10) minute use interval is programmed into electronic circuit 186 of access key device 120.

Once access key device 120 is programmed with the safe deposit box information and access code information, it is then removed from programming terminal 220 and carried by the user to the safe deposit box identified on the display means 182. Access key device 120 is then placed over the door panel 32 such that the key blade 158 and male connector 172 on the access key device 120 are received respectively within slot 84 in lock cylinder 82 and female connector 108 of the lock assembly 40, as illustrated in FIGS. 1 and 6. In this position, the electronic circuit 186 within access key device 120 is electronically connected to the electronic circuit 100 within lock assembly 40. The access code stored in memory within the access key device 120 is then compared to the access code stored in memory within the lock mechanism 40. Delay circuit means 104 of electronic circuit 100 of lock assembly 40 controls communication process speeds with electronic circuit 186 of access key device 120. The communication process speed is set to slow down normal computer processing speeds and to require several seconds to compare the eight digit. In this respect, the slow processing speed provides a security feature which prevents possible deciphering of the access code in a short period of time by a random number generator.

If access key device 120 is positioned on the proper safe deposit box 12, and if the access code stored within memory of access key device 120 matches the access code stored in memory in lock assembly 40, electronic circuit 100 within the lock assembly 40 is operable to energize electromechanical actuator 96 to move solenoid pin 98 same to its second retracted position. Power to actuate electromechanical actuator 96 is provided by power source 184 within the portable access key device 120. Timing means of electronic circuit 186 within access key device 120 includes a timing feature which limits the time period in which electromechanical actuator 96 is energized once the proper access code has been received. In the embodiment shown, electromechanical actuator 96 remains energized for approximately ten (10) seconds, after which electromechanical actuator 96 is deactivated and returns to its first normal position. With electromechanical actuator 96 moved to retracted position, movement of the lock bolt 62 from its first lock position to its second unlocked position is permitted. Actual movement of the lock bolt is caused by rotating knob 142 on access key device 120 about axis A. Once lock bolt 62 has moved from its locked position to its unlocked position, door panel 32 of the safe deposit box 12 may be opened to allow access to the box or container therein.

According to another aspect of the present invention, once the proper access code programmed into access key device 120 has been compared and verified against the access code stored in lock assembly 40, processing means within electronic circuit means 186 of access key device 120 automatically erases the programmed access code and safe deposit identification number stored in memory in access key device 120, thereby rendering access key device 120 unable to be used again to open the specific safe deposit box. In this respect, once access key device 120 has been used to open a safe deposit box 12, or in the event that the safe deposit box 12 is not opened within the time period allowed, access key device 120 must be returned to central control terminal 200 to be reprogrammed to allow access to a safe deposit box.

Once the user has completed his or her activity with respect to the articles within the container stored within the safe deposit box, it may be returned to the safe deposit box cubicle. Door panel 32 is then closed and knob 142 rotated to return lock bolt 62 to its first normal, locked position. Once lock bolt 62 is returned to its locked position, the spring-biased solenoid pin 98 returns to its first position, as aperture 78 in latch plate 76 is brought into alignment with aperture 56 in housing 20 and the free end of solenoid pin 98. Access key device 120 is then removed from the safe deposit box 12 by withdrawing it from connector 108 and key slot 84 of cylinder 82. Access key device 120 may then be returned to the custody of the bank employee to be reprogrammed for use by another customer in accessing another safe deposit box.

As shown in FIG. 1, a typical safe deposit box installation 10 includes door panels 32 which hinge about the right side and the left side about a common hinge post 26. As shown in FIG. 1, the relative position of connector 108 and mechanical cylinder 82 for a right-hinged door panels are opposite for left-hinged door panels. Use of access key device 120 for the respective types of doors is accomplished by merely inverting access key device 120, 180° to align the respective connector 108, 172 and key blade 158 and lock cylinder 82. In accordance with one aspect of the present invention, central control terminal 200 includes memory means for storing information regarding the type of door panel 32 which exists for a particular safe deposit box 12. Central control terminal 200 is operable to program access key device 120 based upon such information wherein the numeric display shown on display means will always be in an upright correct reading position based upon whether the safe deposit box to be opened is a right-hand hinged or left-hand hinged door panel. Thus, the orientation of the alphanumeric display of a programmed access key 120 device will assist in indicating proper orientation when attaching access key 120 device to the respective safe deposit box door panel 32.

The present invention thus provides an electronic lock system for controlling access to a plurality of enclosures, each having an openable and closeable panel. More specifically, the present invention provides an electronic lock system for a safe deposit box installation which provides the advantages of an electronic system without requiring hard wiring each safe deposit box to a central computer terminal. More importantly, the present invention facilitates retrofitting existing mechanical safe deposit boxes by merely replacing an existing mechanical lock assembly with an electronic lock assembly according to the present invention. Thus, existing mechanical safe deposit box installations can be retrofit to an electronic system without the major cost investment of replacing the entire safe deposit box installation. Moreover, the present invention provides an electronic lock system which is wire free, and maximizes internal storage space by eliminating the wiring connecting each enclosure to a central computer as typically found in existing electronic safe deposit box systems.

Figure 14:
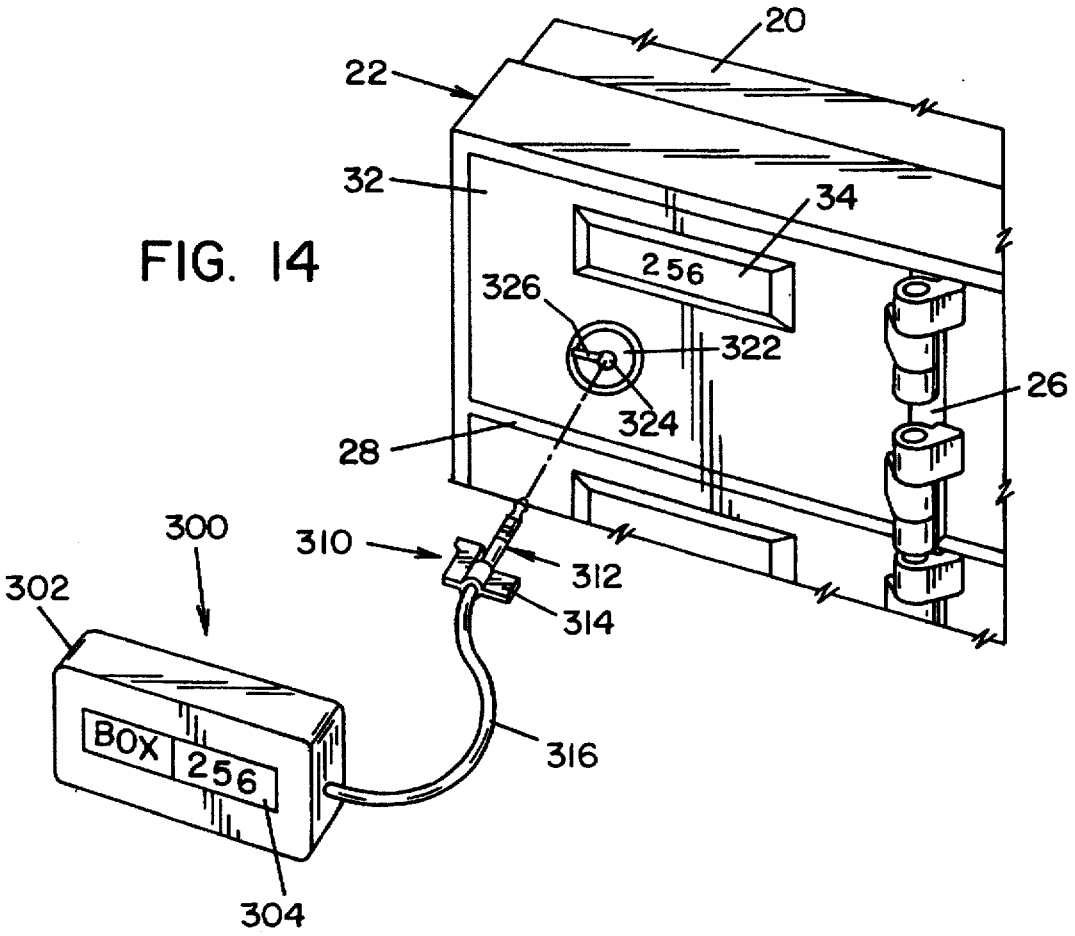
FIG. 14 is a perspective view of a safe deposit box and a portable electronic key device illustrating an alternate embodiment of the present invention.
Figure 15:
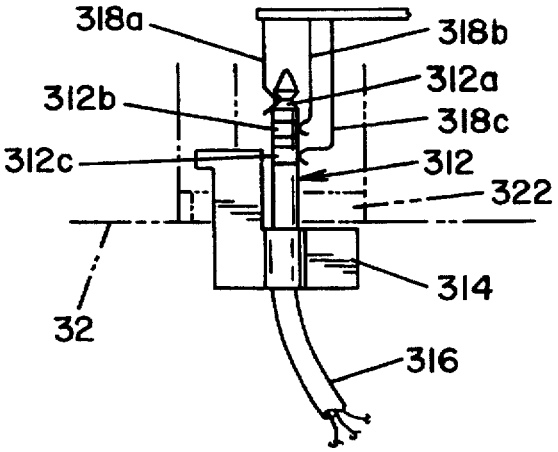
FIG. 15 is an enlarged view of a combination mechanical/electrical connector on the electronic key device shown in FIG. 14, showing the connector positioned within the lock mechanism (shown in phantom) of the safe deposit box.

FIGS. 14 and 15 show a portable electronic access key device 300, illustrating an alternate embodiment of the present invention. Electronic key device 300 is shown together with a safe deposit box installation of the type previously described. In this respect, components of the safe deposit box installation which are similar to the installation previously described have been designated with like numbers and shall not be discussed. Electronic access key device 300 is comprised of a generally rectangular housing 302 having a display panel 304. Housing 302 is adapted to contain the operative components of access key device 300. Such components would be similar in design and function to those previously described with respect to electronic key device 120 (i.e., an electronic circuit board including processing means for performing the function previously described, and a power unit). As with key device 120, the processing means within electronic key device 300 is connected to display panel 304 to display the identification number of the safe deposit box to be opened. Unlike electronic key device 120, which includes an electrical connector 172 and a separate mechanical actuator blade or key 158, electronic key device 300 includes a single connector assembly 310 which is comprised of an electrical plug 312 and a key element 314. An electrical cable 316 connects plug 312 to the electronic circuit board within housing 302. Cable 316 may be flexible or have a rigid outer sleeve.

Plug 312 and key element 314 are dimensioned to be received in a combination electrical/mechanical tumbler 322, mounted in each safe deposit box door. Tumbler 322 incudes a centrally located bore 324 dimensioned to receive plug 312 and a slot 326 dimensioned to receive a portion of key element 314, as best seen in FIG. 15. Tumbler 322 is designed such that when plug 312 is inserted within bore 324 it is electrically connected to the electrical components within the lock mechanism within the door. In other words, plug 312 is an electrical connector which communicates the electronic components within key device 300 with the electronic components within the door's lock mechanism to perform the functions described previously with respect to electronic key device 120 (i.e., compare access codes, transmit power to the electronic door lock mechanism, etc.). As seen in FIG. 15, plug 312 includes a plurality of contacts 312*a*, 312*b*, 312*c* which are connected by contacts 318*a*, 318*b* and 318*c* to the electronic circuit within the door's lock mechanism.

Key element 314 is dimensioned such that when plug 312 is inserted within bore 324, a portion of key element 314 is disposed within slot 326 and a portion of key element 314 is outside slot 326. The portion of key element 314 outside slot 326 is adapted to be manipulated by the user to rotate tumbler 322 about its axis. Rotation of tumbler 322 is operable to move the door's lock bolt (by means not shown) if the proper access code has been communicated through plug 312 to the lock mechanism by electronic access key device 300.

Thus, in the embodiment shown in FIGS. 14 and 15, a single combination connector assembly 310 is provided to establish the electronic link between key device 300 and the electronic circuit within the door's lock mechanism, and to impart physical motion to the lock mechanism to move the lock bolt.

The present invention has been described with respect to an electronic safe deposit box system for use in banking operations. It will be appreciated that the present invention has other, broader applications, and may be used in other situations where it is desirable to control access to plurality of storage locations. For instance, the present invention may be utilized for limiting access to storage cabinets, file cabinets, or the like. Further, modifications and alterations will occur to others upon their reading and understanding of the specification. For example, in the embodiment shown, processing means 104 of lock assembly 40 and processing means 188 of access key device 120 are described as performing specific functions with respect to the operation of the present invention. As will be appreciated, several of the functions indicated as performed by a designated processing means may be incorporated in the other processing means without deviating from the present invention. It is intended that all such modifications and alterations be included insofar as they come within the scope of the patent as claimed or the equivalents thereof.

Having described the invention, the following is claimed:

1. An electronic lock system for controlling access to a plurality of enclosures each having an openable and closeable panel, said system comprised of:

a lock mechanism mounted to each of said panels, said lock mechanism having a lock member movable between a first position locking said panel and a second position unlocking said panel, each of said lock mechanisms having a specific access code allowing movement of said lock member from said first position to said second position;

identification means for identifying individuals authorized for access to one or more of said enclosures;

processing means for storing information regarding access codes for each of said enclosures and individual identification information, and for identifying an enclosure that an authorized individual is allowed access to; and a hand-held portable key device for use with said lock mechanisms on said panels, said key device being mountable onto said panels to remain in place thereon, said key device having memory means programmable by said processing means for storing an access code to a lock mechanism on one of said panels and means for erasing said access code from said memory means after a predetermined period of time.

2. An electronic lock system as described in claim 1 wherein said lock mechanism includes an electronic circuit controlling movement of said lock bolt, said electronic circuit including an electrically operable element for regulating movement of said lock bolt, programmable memory means for storing an access code, and comparator means for comparing said access code stored in the memory means of said key device.

3. An electronic lock system as described in claim 2 wherein said electronic circuit is energizable by an external power source caried in said key device.

4. An electronic lock system as described in claim 2 wherein said electrically operable element is a solenoid which is operable when energized to allow movement of said lock bolt.

5. An electronic lock system as described in claim 1 wherein said identification means is comprised of a magnetic card reader.

6. An electronic lock system as defined in claim 1 wherein each of said enclosures includes an identification number and said portable key device is programmable by said processing means to store said identification number in memory, said key device further including display means for displaying said identification number.

7. An electronic safe deposit box system comprised of:

a plurality of safe deposit boxes each having a door panel with a pair of spaced-apart apertures formed therein, each of said door panels having an electronically controlled locking mechanism mounted thereto with a specific access code allowing unlocking of said locking mechanism, said locking mechanism including a mechanical tumbler extending through one of said apertures and an electrical connector extending through the other of said apertures;

identification means for receiving user identification information from a user of said safe deposit box system;

processing means utilizing said user identification information to identify a safe deposit box and a corresponding access code from a table of such information; and a portable key device for use with said locking mechanism to unlock said locking mechanism, said key device including a mechanical connector dimensioned to mate with and operate said mechanical tumbler of said locking mechanism and an electrical connector dimensioned to attach to said electrical connector on said locking mechanism, said key device having temporary memory means programmable by said processing means for storing a safe deposit box number and a code access number.

8. An electronic safe deposit box system as described in claim 7 wherein said lock mechanism includes a mechanical lock bolt movable between a locked position and an unlocked position, and an electronic circuit controlling movement of said lock bolt.

9. An electronic safe deposit box system as described in claim 8 wherein said electronic circuit is energizable by said key device.

10. An electronic safe deposit box system as described in claim 8 wherein said electronic circuit includes:

an electrically operable element for regulating movement of said lock bolt between said locked position and said unlocked position;

programmable memory means for storing at least one access code;

comparator means for comparing said access code stored in said programmable memory means with an access code stored in the memory means of said key device, and circuit means for energizing said electrically operable element to allow movement of said lock bolt from said locked position to said unlocked position.

11. An electronic safe deposit box system as described in claim 10 wherein said electronic circuit further includes time limiting means for limiting the time said electrically operable element is energized.

12. An electronic safe deposit box system as described in claim 7 wherein said identification means is a magnetic card reader.

13. An electronic safe deposit box system as described in claim 7 wherein said identification means identifies a physical characteristic of said user.

14. An electronic safe deposit box system as described in claim 7 wherein said portable key device includes an internal power source for energizing said lock mechanism.

15. An electronic safe deposit box system as described in claim 7 wherein said portable key device includes display means for displaying the safe deposit box number programmed into said memory of said key device by said processing means.

16. An electronic lock system for controlling access to a plurality of enclosures each having an openable and closeable panel, said system comprised of:

a lock mechanism mounted to each of said panels, said lock mechanism having a mechanical lock member movable between a first position locking said panel and a second position unlocking said panel, each of said lock mechanisms having electronic circuit means including memory means for storing a specific access code and lock control means allowing movement of said lock member from said first position to said second position, processing means for storing information regarding access codes for each enclosure lock mechanism, and a small, hand-held portable key device for use with said lock mechanisms on said panels, said key device and including mechanical connection means for connection with said lock member and electronic connection means for connection with said electronic circuit means in said lock mechanism, and being mountable onto said panels by said mechanical and electronic connection means to remain in place thereon, said key device further including memory means programmable by said processing means for storing a single access code to a lock mechanism on one of said panels, an electrical power source for energizing said control means in said lock mechanism and means for erasing said access code after a predetermined period of time.

17. An electronic safe deposit box system as described in claim 16 further comprising:

identification means for identifying individuals authorized to have access to one of said enclosures.

18. An electronic safe deposit box system as described in claim 16 wherein said processing means includes means for storing information for identifying each of said enclosures; and said portable key device incudes display means for displaying information identifying an enclosure.

19. A method for controlling access to a plurality of enclosures each having an openable and closeable panel, comprising the steps of:

providing each of said panels with a lock mechanism having a mechanical lock member movable between a first position locking said panel and a second position unlocking said panel, each of said lock mechanisms having a electronic circuit with a specific electronic access code allowing movement of said lock member from said first to said second position;

storing said access code for each of said panels in a remote electronic processing means;

transferring the access code for a selected enclosure to be opened from said electronic processing means to a portable electronic transfer device having temporary memory of a short duration;

transporting said electronic transfer device to said selected enclosure;

mounting said transfer device onto a specific panel to remain in place thereon in electronic communication with said electronic circuit;

electronically communicating said electronic access code from said electronic transfer device to said lock mechanism allowing a short period of time for movement of said lock member from said first position to said second position; and erasing said access code from said transfer device.

20. An electronic safe deposit box system comprised of:

a plurality of safe deposit boxes, each having a safe deposit box identification number and a lock mechanism, said lock mechanism including an electronic circuit with a specific electronic access code programmed therein, allowing unlocking of said lock mechanism;

self-contained processing means for storing information identifying each of said safe deposit boxes and the access code corresponding to each of said safe deposit boxes;

a self-contained portable electronic key having memory means programmable by said processing means for storing an access code, said electronic key being mountable onto each of said safe deposit boxes to remain in place thereon, said key including means to connect said memory means to said electronic circuit within said lock mechanism to communicate said access code with said electronic circuit and means for erasing said access code from said memory means after a predetermined period of time.

21. An electronic safe deposit box system as described in claim 20 wherein said electronic key includes means for erasing said memory once said memory means has communicated said access code with said electronic circuit.

22. An electronic safe deposit box system as described in claim 20 further comprising display means on said electronic key device for identifying the safe deposit identification number for an access code programmed into said memory.

23. An electronic safe deposit box system as described in claim 20 wherein said lock mechanism includes a movable lock bolt and said electronic circuit includes an electromechanical actuator for controlling movement of said lock bolt.

24. An electronic safe deposit box system as described in claim 20 wherein said electronic key device includes an electrical power source connectable to said electronic circuit for providing power to said electronic circuit.

* * * * *